United States Patent [19]

Bone

[11] Patent Number: 4,651,913

[45] Date of Patent: Mar. 24, 1987

[54] VARIABLE PITCH FEED OF FASTENERS

[75] Inventor: Arnold Bone, Needham, Mass.

[73] Assignee: Dennison Manufacturing Company, Framingham, Mass.

[21] Appl. No.: 744,587

[22] Filed: Jun. 14, 1985

[51] Int. Cl.[4] ..... B25C 1/00

[52] U.S. Cl. ..... 227/67

[58] Field of Search ..... 227/67

[56] References Cited

U.S. PATENT DOCUMENTS 4,456,162 6/1984 Furutsu ..... 227/67
4,461,417 7/1984 Furutsu ..... 227/67
4,465,218 8/1984 Furutsu ..... 227/67
4,482,087 11/1984 Furutsu ..... 227/67

FOREIGN PATENT DOCUMENTS 56-48939 5/1981 Japan .

*Primary Examiner*—Paul A. Bell
*Attorney, Agent, or Firm*—Gary S. Winer

[57] ABSTRACT

Variable pitch feed of fasteners by a unitary, single toothed feed member. Back-up of the fasteners from the feed position is prevented and the individual fasteners are securely positioned for ejection.

6 Claims, 19 Drawing Figures

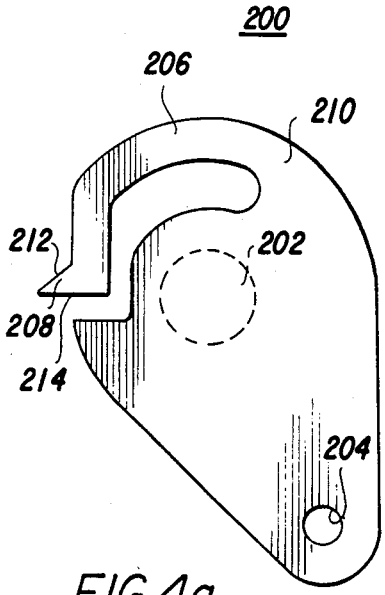
FIG. 4a
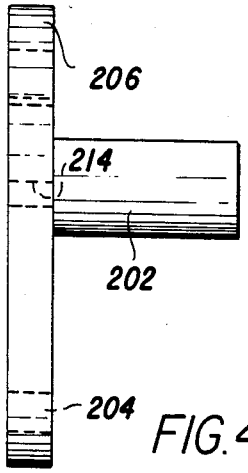
FIG. 4b
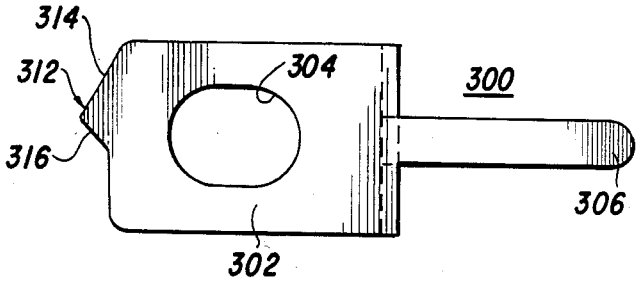
FIG. 5a
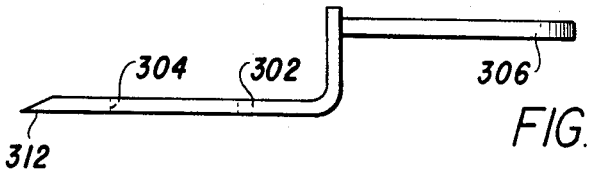
FIG. 5b
FIG. 5c
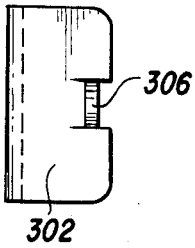

VARIABLE PITCH FEED OF FASTENERS

BACKGROUND OF THE INVENTION

This invention relates to the feed of fasteners, and more particularly to the variable pitch feed of fasteners.

A common fastener for tagging or attaching items is of the kind shown and described, for example, in U.S. Pat. No. 3,380,122. The fasteners are in an assemblage including a connecting bar, a plurality of coplanar connecting stubs extending from the connecting bar, a cross bar angularly disposed on each stub, a filament extending from each cross bar, and, typically, a head attached to each filament. Common fastener attaching apparatus, such as is shown and described for example in U.S. Pat. No. 4,416,407 are designed to install fasteners disposed at a unique distance, relative to each other, on the connecting bar. Typically, a feed wheel is provided having circumferential teeth matable with the assemblage stubs, operable to advance the assemblage in the apparatus. The number and pitch of the feed wheel teeth correspond to the pitch, or relative separation, of fasteners on the assemblage. However, fasteners are provided in varieties, for which it is common practice to have a different fastener dispensing apparatus for each variation.

Accordingly various attempts have been made to provide for feeding, in a single apparatus, of different assemblages, each having a unique pitch. Japanese publication No. 48939 dated 5/2/81 shows a fastener installation apparatus including a feed member having cooperative feeding and anti-back-up members. In one embodiment, an advance mechanism includes a U-shaped rod, the rod ends engagable with an installed fastener assemblage. In an alternative embodiment, two rods engage the assemblage. In each embodiment, an upper rod acts to advance the assemblage, and a lower rod serves to prevent upward movement of the assemblage during feeding. Both rods may bend in either direction, however, each rod end is provided with an angled upper surface so that downwards movement of the assemblage is favored. The feeding strength of this apparatus is limited by the resiliency, or biasing strength, of the upper rod. As the strength of the upper rod is increased, so too must the strength of the lower rod be increased, otherwise, the assemblage will back-up as the upper rod is urged upwardly. As a result, advancing strength is dissipated by the lower rod. Thus only a small advancing force can be generated by this design. Therefore, this apparatus is vulnerable to misfeeding and jamming, particularly where the assemblage fails to slide smoothly within the guide grooves of the apparatus.

U.S. Pat. No. 4,461,417 shows an apparatus designed to install fastener assemblages of varying pitch. A claw is pivotally mounted to a vertically moveable cam plate, the claw being biased in the direction of the connecting bar. A stationary claw with downwardly angled teeth is provided for the purpose of preventing upward movement of the connecting bar during feeding. In operation, the cam plate is raised, causing the claw to be dragged upwardly along the connecting bar. When the trigger is released, the cam plate is lowered, wherein the claw, or in an alternative embodiment, the teeth, engage the connecting bar and urge the assemblage downwardly. Since the claw is not drawn away from the connecting bar, an upwards force is exerted upon the connecting bar. A disadvantage to this design resides in the pivotal arrangement of the claw. As the cam plate is raised, the claw is pressed with continually greater force against the connecting bar, raising the potential for a jam. As the cam plate is lowered, the claw does not contact the connecting bar until the claw has pivoted into position, thus the connecting bar may not be advanced sufficiently to position the next fastener for ejection. Additionally, the design depends on the claw or teeth cutting into the connecting bar. Since fastener assemblages are fabricated from a wide variety of materials, there exists the possibility that the claw will either imbed itself too deeply into the connecting bar, causing a jam, or will fail to engage, resulting in a misfeed.

In a third approach, taken in U.S. Pat. No. 4,465,218, a tooth is moveably mounted within a pivotable base. The tooth is biased in the direction of the assemblage, pivoting on a pin. To prevent the tooth from overextending, a pin extends from the base into an aperture located near the tooth. When the trigger is depressed, the base pivots urging the tooth upwards. The tooth is caused to pivot, deflecting around the next stem. When the trigger is released the tooth engages the stem and urges the assemblage downwards. One disadvantage of this design is that all of the advancing and biasing force is exerted upon a small pivot pin which is subject to wear and breakage. Another disadvantage is that the design requires two carefully mated parts which must be assembled, thus raising the cost of the apparatus.

To prevent back-up of the assemblage during feed, the '218 patent provides a tooth biased in the direction of the assemblage. The tooth has an upper profile disposed at an angle to the axis of the assemblage, thus permitting downwards movement. A lower profile is disposed perpendicular to the axis of the assemblage, thus preventing upward movement of same. A problem with this design is that the device provides for only a fixed stub thickness. A thicker stub would not fit beneath the lower profile. A thinner stub could move up or down below the lower profile. As a result, the push rod, or plunger, may not squarely engage the cross bar, and thus jamming can arise. Additionally, this design does not permit the fastener assemblage to be withdrawn without additional devices for retracting the anti-back-up member.

It is therefore an object of the invention to provide a reliable variable pitch fastener installation apparatus.

It is a further object of the invention to provide for high strength advancing of the fastener assemblage.

It is an additional object of the invention to provide for secure positioning of the fastener to be ejected, while simultaneously preventing unwanted back-up of the assemblage during feeding.

It is another object of the invention to provide for simple and easy removal of a fastener assemblage.

It is yet another object of the invention to provide a fastener installation apparatus of relatively very low cost, incorporating a small number of parts, which functions with great reliability.

It is an additional object of the invention to provide for reliable assemblage feeding and positioning, despite significant variations in materials and dimensions in the fasteners installed.

SUMMARY OF THE INVENTION

In accomplishing the foregoing and related objects, the invention provides a variable pitch fastener dispensing apparatus having a unitary feed member. A location member is provided cooperative with the feed member to securely position the fasteners for ejection.

In accordance with one aspect of the invention, the elements of the invention cooperate with existing fastener installation apparatus mechanisms of the type including a trigger, and an ejection plunger cooperative with the trigger via a slide, such as is shown and described for example in U.S. Pat. No. 4,416,407. A second slide having posts at either end of the lever serves to actuate the feed mechanism of the invention. A fastener assemblage installable with the invention includes: a connecting bar; a plurality of coplanar, spaced apart stubs; a cross bar disposed about the end of each stub; a filament extending from each cross bar; and a head portion disposed about the end of each filament.

In accordance with another aspect of the invention, a feed member is provided, coupled to a slide via a linking rod, pivotally mounted to the apparatus frame. A resilient finger extends in a curved manner from the feed member, supported over part of the curve by a mating ridge on the apparatus frame. A tooth is disposed about the end of the finger, positionable between stubs of an installed fastener assemblage. The tooth has an angled upper surface, and a lower surface defining a plane substantially parallel to the axis of the installed connected bar. As the trigger is depressed, the feed member pivots, whereby the finger bends to permit the tooth to ride over the stem of the next fastener to be advanced. When the trigger is released, the tooth engages the upper surface of the stem and urges the assemblage downwards, positioning the fastener for ejection.

In accordance with an alternative embodiment of the invention, a feed member is rotatably mounted to the apparatus frame via an elongated recess cooperative with a pin. A tooth is disposed about the upper portion of the feed member, engageable with the assemblage. Friction is applied to the feed member, at a location between the rotating pin and the linking rod. As the trigger is depressed, the feed member moves about the friction area, disposing the pin at the forward side of the elongated recess. As a result, the tooth is drawn away from the assemblage. As the trigger is released, the feed member moves about the friction area, disposing the pin at the rearward side of the recess, positioning the tooth above the fastener next to be ejected. As the trigger is further released, the feed member pivots about the pin, whereby the tooth urges the fastener into position for ejection.

In another embodiment of the invention, a location member is provided for positively orienting the fastener for ejection, and for preventing upwards movement of the assemblage during the advancing steps. The location member is biased in the direction of the fastener assemblage, and has a tooth cooperative with the fastener studs to securely position successive fasteners. The tooth has an upper profile defining a low angle with respect to the axis of assemblage movement, while a lower profile defines a higher angle. A result, the assemblage encounters a low resistance towards downwards movement, as when advancing, and a high resistance to upwards movement, as when the feed member tooth moves upwards. Additionally, the angled lower surface applies a constant force against the fastener, maintaining same in proper orientation for ejection.

BRIEF DESCRIPTION OF THE DRAWINGS

Other aspects of the invention will become apparent after considering several illustrative embodiments taken in conjunction with the accompanying drawings, in which:

FIGS. 4*a* and 4*b* are a front and side view of the feed member of FIG. 1;

FIGS. 5*a*, 5*b*, and 5*c* are a front, side, and end view of the location member shown in FIGS. 1 and 2;

DETAILED DESCRIPTION OF THE INVENTION

With reference to FIGS. 1–9, the present invention provides a fastener dispensing apparatus, or gun 10, having a variable pitch feed member 200, and a location member 300. Elements 200 and 300 cooperate to provide for reliable advance of a variety of fastener assemblages.

Figure 1:
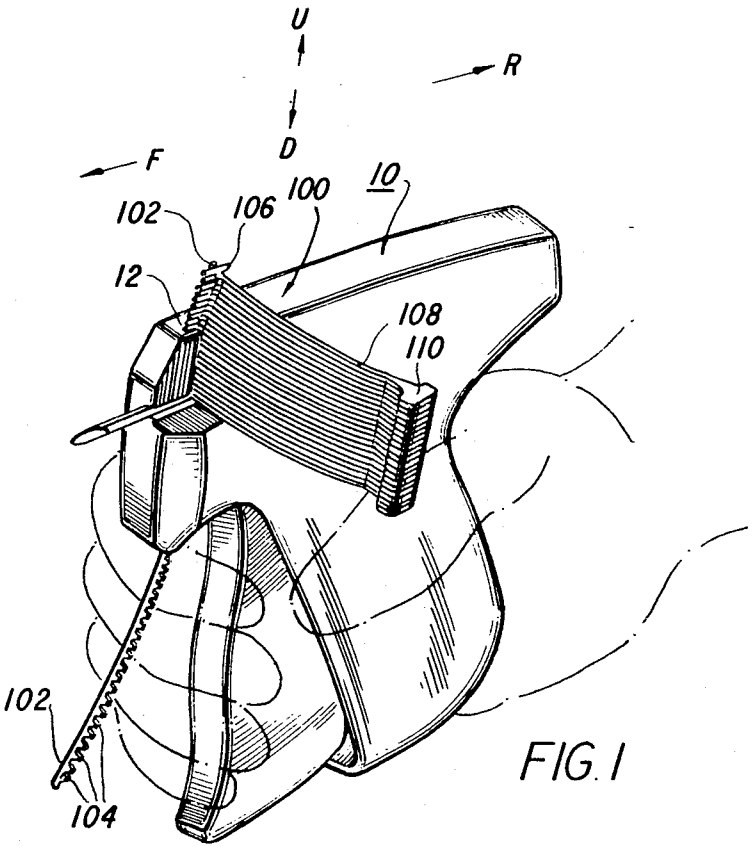
FIG. 1 is a perspective view of an installation apparatus in accordance with the invention, with a fastener assemblage installed.

As can be seen in FIG. 1, the fastener apparatus 10 of the invention receives a fastener assemblage 100 in a guide groove 12 disposed at the front of the apparatus. Assemblage 100 comprises a connecting bar 102; a plurality of coplanar stubs 104; a cross bar 106 perpendicularly disposed about the end of each stub 104; a filament 108 extending from each cross bar 106; and, typically, a head portion 110 disposed about the end of each filament. The distance between stubs 104 represents the "pitch" of the assemblage. It has become increasingly common for fasteners to be disposed at a closer pitch on the connecting bar, thereby reducing mold size and lowering cost, as well as providing for less frequent reloading. However, prior fastener assemblages exist in great quantity. Therefore, there exists a variety of different pitch fastener assemblages, typically ranging from 0.04" to 0.15" (1–4 mm) between adjacent stubs. The present invention provides for installation of a wide range of these fastener assemblages.

The feed and location members of the invention may be employed with a variety of known actuating mechanisms. What is required is a frame for supporting the elements, a plunger for ejecting the fasteners, and means for pivoting the feed member. U.S. Pat. No. 4,416,407 provides such an apparatus, which includes a frame 14, a trigger 13, a plunger 15, a control lever 16 and a linking rod 19*h*. While the '407 mechanism is illustrated, it should be understood that a variety of mechanisms can be employed in combination with the elements of the invention, as will be understood from the description below. For the purpose of this discussion, with reference to FIG. 1, front is indicated by arrow F; rear, or backward by arrow R; up by arrow U; and down by arrow D.

Figure 2:
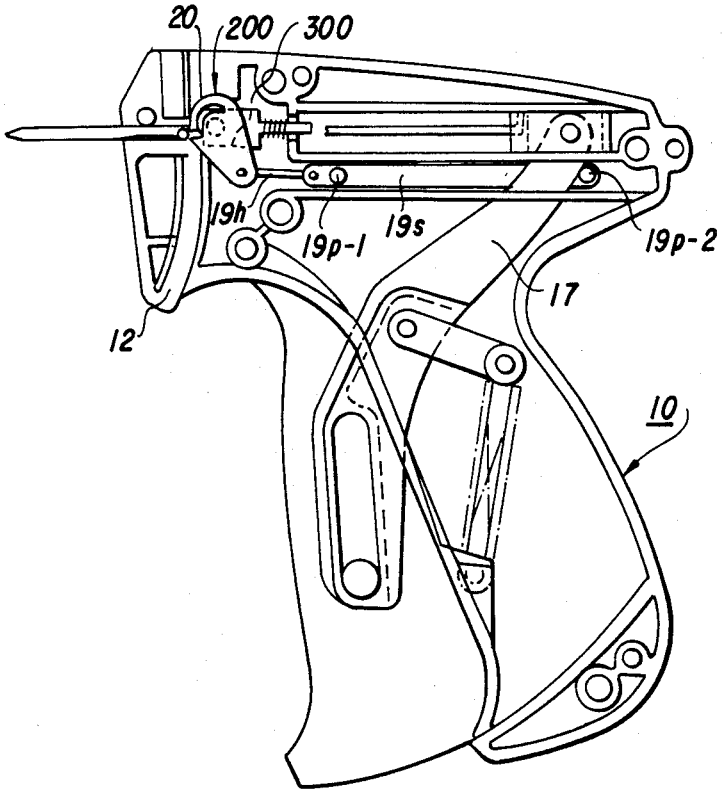
FIG. 2 is a sectional view of a fastener installation apparatus in accordance with the invention, showing the location member and a feed member embodiment.

With reference to FIGS. 2 and 4, a preferred embodiment of the invention includes a feed member 200, comprising a pivot pin 202, link aperture 204, and finger 206 having tooth 208. Feed member 200 is preferably fabricated from a resilient wear resistant material, such as NYLON or AN ACETAL RESIN. Pin 202 is received within the frame, or alternatively, the frame is provided with a pin matable with an aperture in feed member 200, so that the feed member has a fixed pivot. Aperture 204 couples to linking rod 19*h*. Finger 206 has a curved profile, and is integrally formed from the feed member body 210. The apparatus frame is provided with a curved ridge 20, matable with the curved profile of finger 206. Tooth 208 has an upper surface 212 defining an angle with respect to the axis of the installed assemblage, when the feed member is in an advanced position, as shown in FIG. 2. In a preferred embodiment, surface 212 thus defines an angle of 30°–45°, preferably 40°. In this position, the tooth lower surface 214 is approximately perpendicular to the axis of the assemblage. It should be understood, however, that a range of angles may be advantageously employed for surfaces 212 and 214, depending on the intended application.

With reference to FIGS. 2 and 6, the operational steps in advancing the fastener assemblage 100 may now be described. As link 19*h* is advanced via slide 19*s*, feed member 200 is pivoted about the axis of pin 202. Link 19*h* provides a low resistance, low wear connection to feed member 100. As can be seen in FIG. 6(*a*), a tooth 208 is disposed above stub 112, which previously was coupled to a fastener, now ejected. After a fastener has been expelled through the needle, control lever 16 contacts post 19*p*-1, thus urging link 19*h* forwards. Feed member 200 rotates about pivot 202, whereby finger 206 is bent inwardly as tooth 208 is pushed back by stem 114. Due to the angle of upper surface 212, tooth 208 slides easily over stub 114. As feed member 200 continues to rotate, tooth 208 moves in a direction tangential to the direction in which the assemblage is fed, shown by arrow A, FIG. 6B, thus causing tooth 208 to become free of stem 114, whereupon finger 206 springs forward disposing tooth 208 between stem 114 and the next succeeding stem 116. Control lever 16 next reverses direction as the trigger is released, and pushes back on post 19*p*-2. As a result, link 19*h* is drawn back, causing feed member 200 to rotate about pivot 202 in an opposite direction, shown by arrow B. Lower surface 214 of tooth 208 contacts the upper side of stem 114, and urges same into ejecting position as feed member 200 continues to pivot. FIGS. 6*c*, 6*d*. During this time, frame ridge 20 supports tooth 208, thus preventing upwards bending of finger 206. This cycle is repeated each time the trigger is depressed and released. Because the movement of tooth 208 is tangential to the axis of assemblage 100, clearance of tooth 208 is favored. As a result, a wider pitch range may be accommodated.

Figure 7:
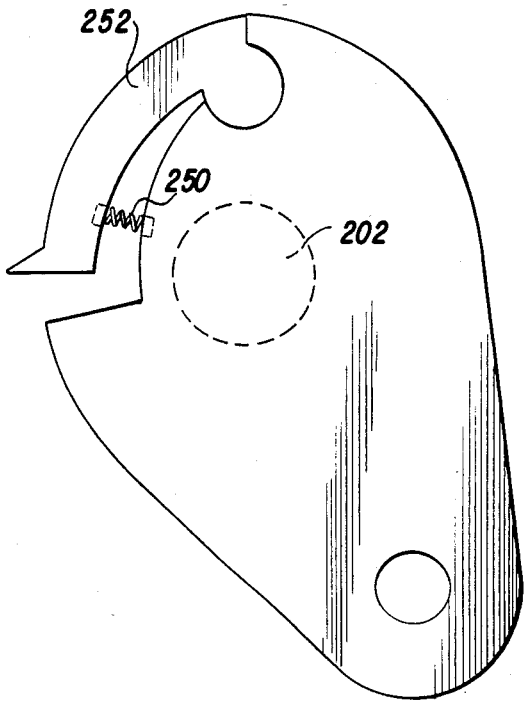
FIG. 7 is a front view of an alternative feed member in accordance with the invention.
Figure 8A:
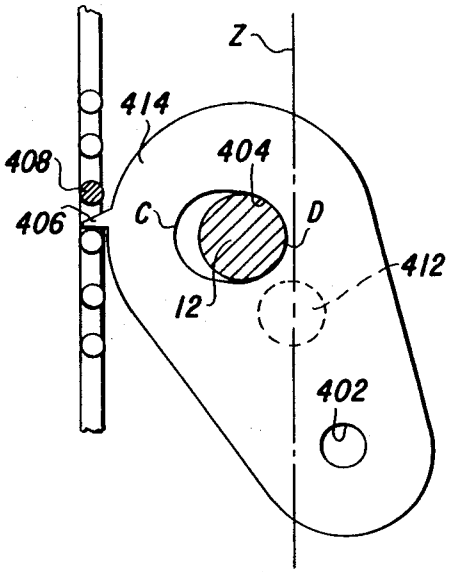
FIGS. 8*a*, 8*b*, 8*c* are a schematic of the steps in advancing a fastener assemblage, in accordance with another embodiment of the invention.
Figure 8B:
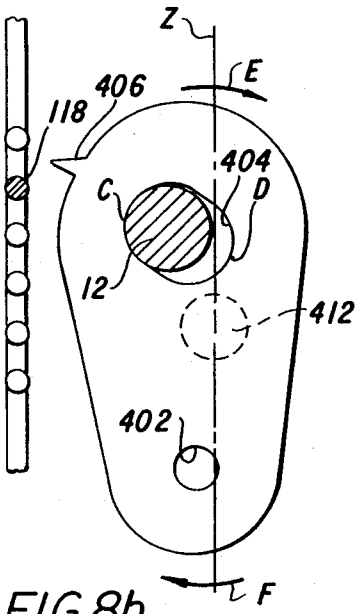
Figure 8C:
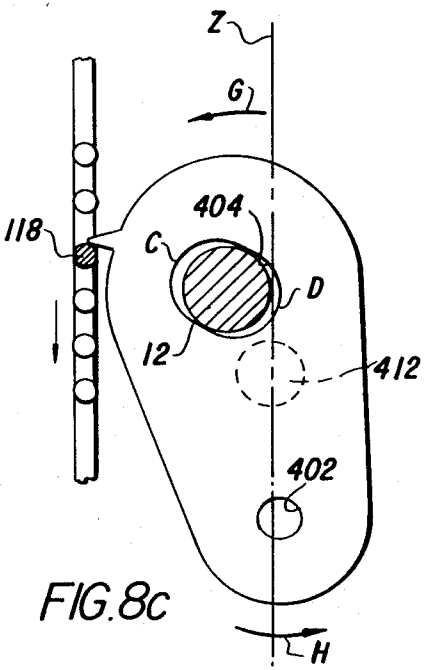

Finger 206 is highly resistant to damage. Due to being integrally formed from the feed member body 210, bending force is distributed over an extended area, as opposed to a particular point. Moreover, great feeding strength is achieved by buttressing the finger with ridge 20. The resiliency of the finger may be varied, however, by employing a biasing spring 250 and pivot finger 252, such as is shown in FIG. 7. This alternative embodiment retains the advantage of being buttressable by ridge 20, yet permits a wide range of resilient forces, depending on the strength of spring 250. An alternative feed member 400 is shown in FIG. 8. Link 19*h* couples to aperture 402. A slot 404 cooperates with a pin 112 mounted to the fastener apparatus frame. Alternatively, a pin may extend from feed member 400 into a recess in the frame. A tooth 406 is provided at the front of the feed member 400, having an angled upper surface 408 and a substantially horizontal lower surface with respect to the longitudinal axis of slot 404. A frictional force is applied to the region indicated by dotted line 412. In operation, as trigger 13 is depressed, link 19*h* is moved forwards causing feed member 400 to pivot about friction region 412. As a result, pin 12 confronts side C of slot 404, whereupon tooth 406 is drawn away from the fastener stems.

Reference line Z is provided to illustrate how feed member 400 is repositioned with respect to friction region 412 and pin 12. As can be seen in FIG. 8*b*, the upper toothed portion of feed member 400 moves in the direction indicated by arrow E, while the lower link apertured portion moves in the direction indicated by arrow F. As the trigger is released, link 19*h* draws the lower portion in the direction indicated by arrow H. Pin 12 is thus caused to confront side D of slot 404, whereupon feed member 400 is displaced with respect to friction region 412, in the direction of the fastener assemblage, causing the upper toothed portion to rotate in the direction indicated by arrow G. The next successive stem 118 is engaged by tooth 406, whereby the fastener assemblage is urged downwards to position the next fastener for ejection, ultimately arriving at the positioning shown in FIG. 8*a*.

Since tooth 406 is rigidly mounted to the feed member body 414, a great advancing force may be generated by this embodiment.

Figure 3:
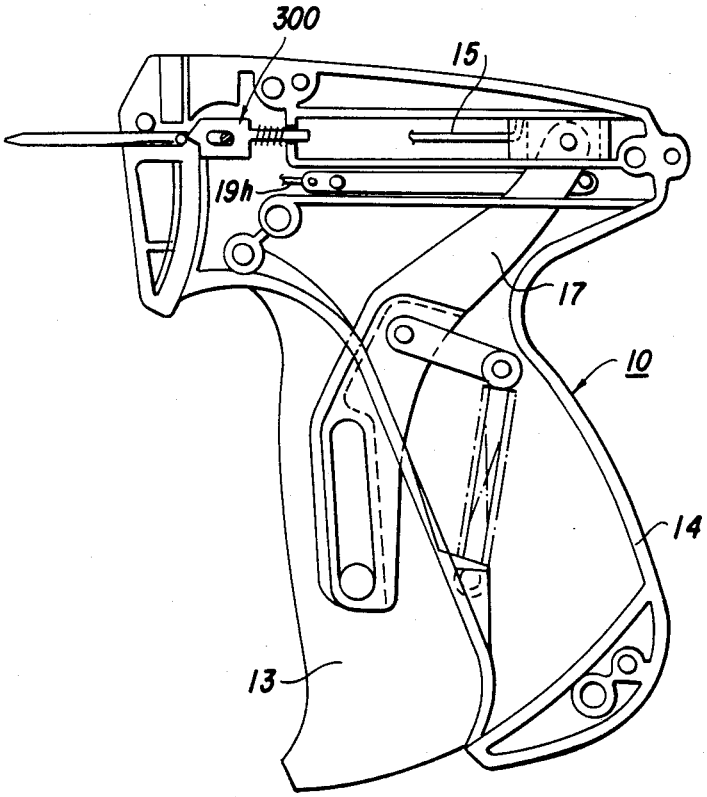
FIG. 3 is the sectional view of FIG. 2, with the feed member removed to more clearly show the location member.
Figure 6D:
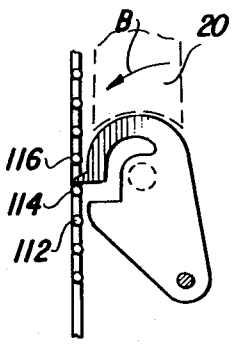
FIGS. 6*a*, 6*b*, 6*c*, and 6*d* are a schematic of the steps in advancing a fastener assemblage, showing the feed member of FIG. 1.
Figure 6C:
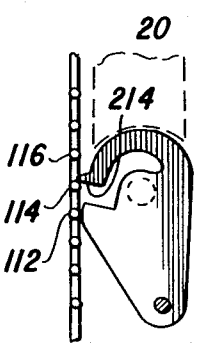
Figure 6B:
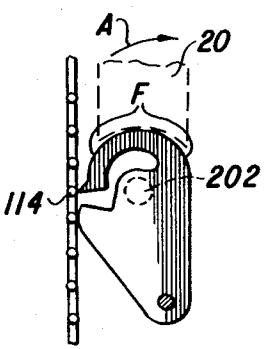
Figure 6A:
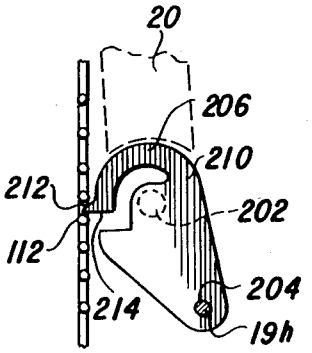
Figure 9A:
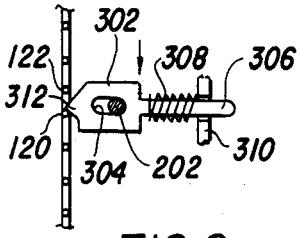
FIGS. 9*a*, 9*b*, and 9*c* are a schematic of the steps in locating a fastener assemblage, showing the locating member of FIGS. 1 and 2.
Figure 9B:
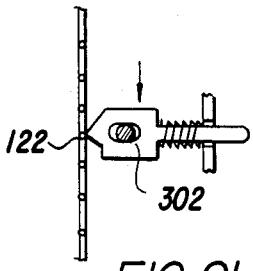
Figure 9C:
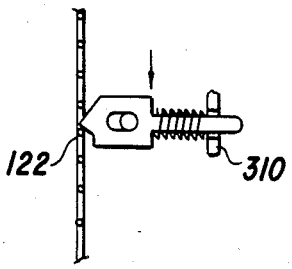

To prevent the fastener assemblage 100 from moving upwards during cycling of feed member 200 or 400, an ejection location member 300 is provided, as shown in FIGS. 3, 5 and 9. Location member 300 comprises a base 302 having a slot 304, a stem 306 extending from base 302, biasing means 308, a stem guide 310, and a tooth 312.

Location member 300 is positioned beneath feed member 200 or 400, wherein pivot pin 202 passes through slot 304. Stem guide 310 is formed as a groove in the fastener body, subject to and additionally providing support to plunger 15. Biasing means 308, for example a spring, is mounted on stem 306, confined between guide 310 and body 302. Thus configured, location member 300 is urged in the direction of the installed fastener assemblage 100. The length of slot 304 determines the maximum range over which location member 302 can move. Tooth 312 is provided with an upper surface 314 defining an angle of low elevation, in a preferred embodiment, in the range of 25°–35°, preferably 30° with respect to the axis of location member 302 movement. Tooth 312 lower surface 316, is provided with a higher angle relative to upper surface 314, in a preferred embodiment in the range of 40°–50°, preferably 45° with respect to the axis of location member 302 movement. The importance of the angular surfaces can now be explained with reference to FIG. 9.

In FIG. 9*a*, location member 300 is urging stem 120 downwards through a force exerted by lower surface 316. Stem 120 is prevented from moving beyond ejection location due to contact between cross bar 104 and the fastener apparatus frame. Due to the high angle of lower surface 316, a constant pressure is maintained against stem 118, rigidly locking same in ejecting position, thereby markedly reducing the possibility of jamming or misfiring. This aspect is of particular importance, since stem thickness can vary considerably among different fastener assemblages. Even where only one stem thickness is employed, molding variation and flash thickness can introduce variation. This problem is eliminated by location member 300, which exerts a constant force downwardly on the stem, regardless of stem thickness. After the fastener connected to stem 120 has been ejected, feed member 200 advances assemblage 100, thereby causing stem 122 to be pushed downwardly against upper surface 314. Due to the low angle of upper surface 314, location member 300 is easily urged rearwardly, thus permitting the assemblage to be advanced. Concomitantly, as feed member 200 is pivoted in direction A, lower surface 316 prevents upwards movement of assemblage 100, due to the high resistance imposed by the higher angle of surface 316.

In feed embodiments 200 or 400, the fastener assemblage 300 is withdrawn by simply pulling the assemblage upwardly out of the guide groove. Feed member 200 or 400 can be pivoted backwards by depressing the trigger, whereby only the resistance of location member 300 is encountered. Alternatively, the trigger can be left undepressed, wherein feed member 400 is urged rearwardly, as the assemblage is withdrawn.

The present invention thus provides a fastener dispensing apparatus which can reliably advance fastener assemblage of differing pitch. A typical pitch range is between 0.045" and 0.080" (1.14–2.03 mm),(stem center to stem center), however, it should be understood that modifications, particularly to the tooth and or finger length, can be made to accommodate pitches outside this range. The invention enables reliable variable pitch feeding with a minimum number of parts. This is accomplished in one embodiment, in part, by reinforcing feed finger 206 with the apparatus frame, and in another embodiment, by the use of a frictional pivot.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for dispensing of fasteners, comprising:
a frame for receiving the fasteners
a feed member rotatably mounted on said frame;
a curved finger pivotally mounted to said feed member;
means for biasing said finger;
a ridge matable with said curved finger operative to support same.

2. Apparatus for dispensing fasteners, comprising:
a frame for receiving the fasteners;
a feed member rotatably mounted on said frame for advancing the fasteners;
a finger integrally hinged to said feed member;
a tooth disposed about the end of said finger;
means for biasing said finger in the direction of the fastener assemblage.

3. Apparatus for dispensing a fastener, comprising
a frame including means for receiving and positioning the fastener;
a single-piece feed member rotatedly mounted on a stationery portion of said frame;
a flexible tooth integral with said feed member for engaging and advancing said fastener; and
means cooperating with said feed member for buttressing the same;
whereby said tooth flexes toward said feed member in one direction of rotation and is restrained in the extent of flexing away from said member as said member is rotated in the opposite direction.

4. Apparatus of claim 3, further comprising:
a resilient finger interposed between said feed member and said tooth.

5. Apparatus of claim 4, wherein:
said resilient finger is curved over a portion of length; and
said frame has a supporting surface matable with said finger curve.

6. Apparatus as defined in claim 3 further including:
a linking rod cooperative with said feed member for rotating the same; and
means for operating said linking rod.

* * * * *